United States Patent [19]

Forster et al.

[11] 4,136,787

[45] Jan. 30, 1979

[54] ELASTIC HINGE OF A CENTRAL BUFFER COUPLING FOR RAIL CARS

[75] Inventors: Hilmar Forster; Wilhelm Günther, both of Wolfenbüttel, Germany

[73] Assignee: Scharfenbergkupplung GmbH, Germany

[21] Appl. No.: 870,633

[22] Filed: Jan. 19, 1978

[30] Foreign Application Priority Data

Jan. 19, 1977 [DE] Fed. Rep. of Germany ..... 2701984

[51] Int. Cl.[2] ..... B61G 9/06

[52] U.S. Cl. ..... 213/40 R; 213/221; 280/485; 293/85; 403/226

[58] Field of Search ..... 267/57.1 A, 63 A, 153, 267/9, 140, 141, 152, 3, 4, 63 R; 308/26, 238; 213/220–223, 18–24, 46 A, 40 R, 41–42, 59, 62, 104, 26, 27, 7, 9, 10, 13, 14, 32 B, 35, 36, 46 R, 40 D; 403/225, 226, 227; 280/486, 485; 293/88, 89, 84, 85, 86, 71 R; 248/348 R

[56] References Cited

U.S. PATENT DOCUMENTS

| | | | |
|---|---|---|---|
| 2,852,286 | 9/1958 | Guy et al. | 403/226 |
| 3,432,200 | 3/1969 | Barton | 293/89 X |

FOREIGN PATENT DOCUMENTS

| | | | |
|---|---|---|---|
| 1068294 | 11/1959 | Fed. Rep. of Germany | 293/85 |
| 2160022 | 6/1973 | Fed. Rep. of Germany | 403/225 |
| 316495 | 11/1956 | Switzerland | 293/88 |

*Primary Examiner*—Trygve M. Blix
*Assistant Examiner*—Douglas C. Butler
*Attorney, Agent, or Firm*—McGlew and Tuttle

[57] ABSTRACT

An elastic hinge of a central buffer coupling for rail cars, comprises a bearing housing which has at least one end with a coupling rod receiving opening into which a coupling rod extends. The interior wall of the housing has a plurality of axially spaced radially inwardly extending annular housing cam surfaces which engage between similar cam surfaces defined on a coupling rod which is inserted into the housing. A plurality of rings are arranged on the coupling rod between the coupling rod cam surfaces and they have outer peripheries which bear on the housing between adjacent housing cam surfaces. The housing interior wall and the coupling rod have an oval cross-section and the rings are held in spaced axial relationship by the coupling rod cams. The housing and the rings may be made of two semiannular parts, and the housing parts may be bolted together.

3 Claims, 3 Drawing Figures

ELASTIC HINGE OF A CENTRAL BUFFER COUPLING FOR RAIL CARS

FIELD AND BACKGROUND OF THE INVENTION

This invention relates in general to the construction of elastic joints and, in particular, to a new and useful elastic hinge of a central buffer coupling for rail cars which includes a housing which is adapted to be articulated to the car over vertical journals and a coupling rod which passes through the housing which is supported by prestressed rings of rubber or plastic disposed between the housing and the coupling rod.

DESCRIPTION OF THE PRIOR ART

An elastic hinge is known from German Pat. No. 1,068,294 in which an elastic body is arranged at the car end under initial stress between the end of the coupling rod and is in the form of a disc, and the housing is articulated on the car, and in which the elastic body is held by a revolving edge on the housing, and also by a revolving shoulder on the coupling rod. Such a hinge permits absorbtion of tensile and compressive forces and ensures the resetting in the vertical direction. However, it has the disadvantage that the elastic bodies are stressed merely in the range of the revolving shoulder for tension or compression. This has the result that the rubber body must have a relatively great Shore hardness, which, in turn, has the drawback that very great forces are required to center the coupling heads in the vertical direction, so that coupling is only possible starting from a certain speed. Since the coupling rod is designed as a disc and the elastic body has a great Shore hardness, this results in a great resetting moment when it swivels about the coupled axle, so that only a small angle of swing can be achieved due to greater forces.

SUMMARY OF THE INVENTION

The present invention eliminates the disadvantages of the prior art in an elastic hinge in which elastic bodies are arranged so that the vertical swivel movement and the rotary movement, about the coupled axle, are only slightly influenced by the elastic bodies, while resetting is always made possible. The rings are arranged perpendicularly to the coupled axle in such a way that both the coupling rod and the inside of the coupling housing have annular cams directed radially toward each other, and the housing and the coupling rod have an oval cross-section and the rings are held spaced axially away from each other by the cams.

The arrangement of the rings perpendicularly to the coupled axle in combination with the arrangement of the cams on the coupling rod and on the housing so that they extend radially toward each other has the effect that, in the case of tensile or energy forces, the rings are stressed not only for tension or compression, but also for shear over their entire cross-section. Selecting an oval cross-section for the housing and the coupling rod has the advantage that, with a relatively small supporting base about the coupled axle, only small forces are generated by an admission of the ring in swivel movements.

Accordingly, it is an object of the invention to provide an elastic hinge of a central buffer coupling for rail cars which comprises a bearing housing having at least one end with a coupling rod receiving opening having a coupling rod extending therein and an interior wall with a plurality of axially spaced radially inwardly extending annular housing cam surfaces which are opposite to radially outwardly extending surfaces of the coupling rod, and including a plurality of rings engaged on the coupling rod between the coupling rod cam surfaces having peripheries bearing on the housing between adjacent housing cam surfaces, the housing interior wall and the coupling rod having an oval cross-section and the rings being held in spaced axial relationship by the coupling rod cam surfaces.

A further object of the invention is to provide an elastic hinge of a central buffer coupling for rail cars which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

DESCRIPTION OF THE PREFERRED EMBODIMENT

Figure 1:
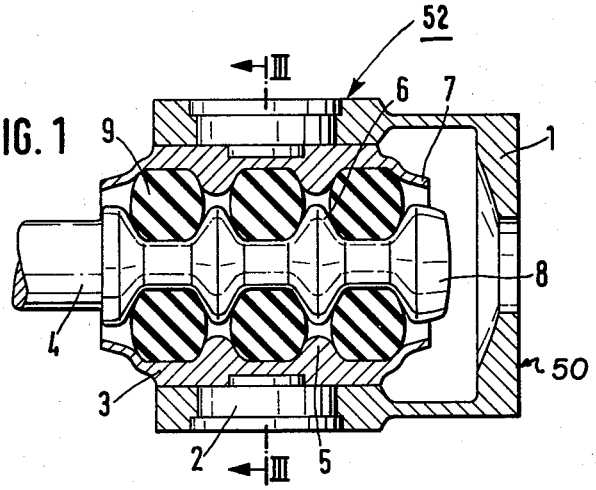
FIG. 1 is a longitudinal sectional view of an elastic hinge of a central buffer coupling for rail cars constructed in accordance with the invention.

Referring to the drawing in particular, the invention embodied therein, comprises an elastic hinge, generally designated 50 of a central buffer coupling 52, which includes a bearing block or housing 1 adapted to be secured on a rail car (not shown) which is connected through journals 2 with a housing 3. Housing 3 has an opening in at least one end into which a coupling rod 4 extends. Coupling rod 4 is connected with a coupling head (not shown) disposed at the end thereof which is out of the housing 3 (not shown), and both the coupling rod and the housing 3 have an oval cross-section in a transverse direction. Both the coupling rod 4 and the inside of housing 3 are provided with respective annular cam surfaces 5 and 6, which are directed toward each other in a radial direction and are located at a substantially common vertical plane, having the same axial spacing therebetween. The housing 3 has end portions 7 also forming radially inwardly directed cam surfaces which abut against end shoulders 8 of the coupling rod.

In accordance with the invention, the coupling rod 4 is held at a predetermined spacing from the interior housing wall by vertical rings 9 made of a rubber or plastic material which are disposed between adjacent housing cam surfaces 5 and coupling rod cam surfaces 6. At the respective ends, the rings 9 abut against a coupling rod cam shoulder 8 and a housing cam surface 7. Rings 9 are inserted under an initial stress and, in order to facilitate the assembly of the rings 9, and to make the initial stress adjustable, housing 3 advantageously comprises two substantially mirror-image half-shells **3*a* and 3*b* which are detachably joined together by screw bolts 10. Rings 9 are advantageously slotted on one or both sides as at 9*a* and 9*b* so as to facilitate the pre-stressing of the rings 9** by deformation of the material bonding the slotted areas.

Since the device according to the invention is used with couplings for different rail cars and different uses, the forces to be absorbed may also vary, so that the number of rings 9 with the respective cams 5 and 6 is determined by the size of the longitudinal forces to be absorbed, that is, the device can have two or more rings 9, and only the length of the device varies, while the Shore hardness of the rings 9 is preferably constant.

Figure 2:
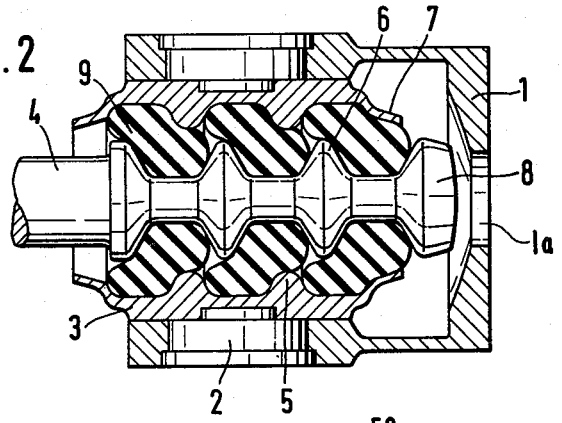
FIG. 2 is a view similar to FIG. 1 of the hinge showing the coupling rod under pressure.
Figure 3:
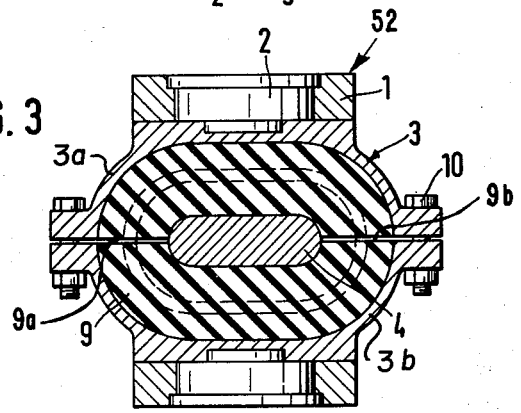
FIG. 3 is a section taken along the line III—III of FIG. 1.

If the coupling rod 4 is subject to compression, as shown for example, in FIG. 2 and which would occur, for example, when two adjacent cars are urged together, the rings 9 are deformed elastically over their entire cross-section simultaneously and uniformly with the displacement of coupling rod 4 relative to housing 3 by the cams 6 and the shoulders 8 relative to the fixed cams 5 and ends 7, where the rings 9 are first stressed for shear. With a further increase of the load, the shearing stress passes over gradually into a compressive stress, since the rings 9 move from cams 6 to the following cams 5 so that the rings are hindered at the end of the loading process from being further deformed or from yielding further. A progressive spring characteristic is thus achieved. The rod 4 is also subject to tensile stressing which occurs during starting, during which time adjacent coupled cars tend to separate. Both tensile and compressive forces are absorbed by the rings 9 of the central buffer coupling 52.

Since coupling rod 4 has to compensate a downwardly directed moment by the weight of the mechanical coupling, but should constantly be in a center position for proper coupling, the outer rings 9 are so selected in their Shore hardness that they counteract this moment and keep the coupling rod in the horizontal position. In a support with two or more split rings 9, the halves of the outer split rings 9 counteracting this moment receive a greater Shore hardness than the other halves of the rings 9 and the other rings.

In cars which have to pass exclusively through greater radii of curves, the resetting forces of the rings 9 is utilized simultaneously to always secure the center position of the coupling rod even against horizontal swing. To this end, housing 3 can be secured firmly on bearing block 1, since the outer ring 9 can then take over the resetting in a side deflection. The bearing block 1 has an outer end face with a center opening 1*a* to vent the interior of the block.

While a specific embodiment of the invention has been shown and described in detail to illustrate the application of the principles of the invention, it will be understood that the invention may be embodied otherwise without departing from such principles.

What is claimed is:

1. An elastic central buffer coupling for two rail cars, comprising a bearing housing adapted to be connected to one of the rail cars and having at least one end with a coupling rod receiving opening, said housing having an interior wall with a plurality of axially spaced radially inwardly extending annular housing cam surfaces, a coupling rod adapted to be connected to the other of the rail cars and having an end extending into said housing with a plurality of radially extending axially spaced annular coupling rod cam surfaces of substantially the same axially spacing as said housing cam surfaces, and a plurality of rings engaged on said coupling rod between said coupling rod cam surfaces with respective ones having outer peripheries bearing on said housing between adjacent housing cam surfaces, said housing interior wall and said coupling rod having an oval cross-section, said rings being held in spaced axial relationship by said coupling rod cams wherein said housing comprises two mirror-image half-shells joined together and detachable bolt means connecting said half-shells together.

2. An elastic hinge, as claimed in claim 1, wherein said housing includes end portions extending inwardly defining additional housing cam surfaces, said coupling rod having an inner end with a shoulder defining an additional coupling rod cam surface, said additional housing cam surface and said coupling rod surfaces corresponding in configuration to said housing cam surface and said coupling rod surface.

3. An elastic hinge, as claimed in claim 1, wherein said rings are slotted.

* * * * *